US008555974B2

(12) United States Patent
Moncus et al.

(10) Patent No.: US 8,555,974 B2
(45) **Date of Patent: *Oct. 15, 2013**

(54) COILED TUBING WELL INTERVENTION SYSTEM AND METHOD

(75) Inventors: James Devin Moncus, Lafayette, LA (US); Joseph Hayden Miller, Jr., Lafayette, LA (US)

(73) Assignee: Devin International, Inc., Lafayette, LA (US)

( * ) Notice: Subject to any disclaimer, the term of this patent is extended or adjusted under 35 U.S.C. 154(b) by 270 days.

This patent is subject to a terminal disclaimer.

(21) Appl. No.: 12/795,665

(22) Filed: Jun. 8, 2010

(65) Prior Publication Data

US 2011/0067887 A1 Mar. 24, 2011

Related U.S. Application Data

(63) Continuation-in-part of application No. 12/074,734, filed on Mar. 6, 2008, now Pat. No. 7,789,155.

(51) Int. Cl.
*E21B 43/00* (2006.01)

(52) U.S. Cl.
USPC ..... 166/313; 166/77.2

(58) Field of Classification Search
USPC ..... 166/384, 313, 77.2; 175/52
See application file for complete search history.

(56) References Cited

U.S. PATENT DOCUMENTS

| | | | | |
|---|---|---|---|---|
| 3,101,816 | A * | 8/1963 | Fox | 52/118 |
| 6,973,979 | B2 * | 12/2005 | Carriere et al. | 175/203 |
| 2009/0151955 | A1 * | 6/2009 | Bamford et al. | 166/335 |
| 2010/0038088 | A1 * | 2/2010 | Springett et al. | 166/313 |

* cited by examiner

*Primary Examiner* — Giovanna Wright
*Assistant Examiner* — Kipp Wallace
(74) *Attorney, Agent, or Firm* — Jones Walker LLP

(57) ABSTRACT

An apparatus having a modular support frame with a top deck. The top deck has a passage therein. A tower is mounted on the top deck. A moveable plate and a track are positioned within the passage. The movable plate is slidingly attached to the track. A support rotary table is disposed within the modular support frame and suspends jointed tubulars. A coiled tubing injector head interface plate is operatively attached to the movable plate, and positioned over the first aperture of the movable plate. The first aperture is positioned over the well in a first position. A rotary table is positioned over the well in a second position. The apparatus is mounted on a transport vehicle in a transport position and moved to a well site. A lifting mechanism lifts the apparatus into an upright position. Well intervention work is conducted with coiled tubing and jointed tubulars.

5 Claims, 15 Drawing Sheets

COILED TUBING WELL INTERVENTION SYSTEM AND METHOD

CROSS-REFERENCE TO RELATED APPLICATIONS

This is a continuation-in-part application of Ser. No. 12/074,734, filed on Mar. 6, 2008.

BACKGROUND OF THE INVENTION

This invention relates to an apparatus and method for performing well intervention work. More particularly, but not by way of limitation, this invention relates to an apparatus and method for performing coiled tubing well intervention operations with jointed tubulars from a platform.

In the drilling, completion, and production of hydrocarbons, an operator may find it necessary to perform various well intervention work. Prior art techniques of performing well intervention work include utilizing traditional drilling rigs and snubbing units. As well understood by those of ordinary skill in the art, drilling rigs and snubbing units produce a large foot print and the cost can be quite significant. Put another way, well intervention work with a drilling rig and/or snubbing units can be very expensive.

One alternative to the large and expensive rigs is for an operator to utilize coiled tubing. As appreciated by those of ordinary skill in the art, coiled tubing units require less space (i.e., smaller foot print), easier to transport, and are more economical to operate. Coiled tubing can be used to perform many well intervention techniques, including but not limited to, drilling, completion, work overs, plug and abandonments, etc. Hence, coiled tubing use is encouraged.

Despite these advantages, coiled tubing use does have some disadvantages. For instance, in the course of performing well intervention work, an operator may find it necessary to utilize jointed pipe. In the case where jointed pipe is used, an operator will need to lift, lower, make-up, break-out, etc. the jointed pipe, and coiled tubing units are not suited for this type of activity. In other words, use of coiled tubing units presents pipe handling problems such as lifting and lowering jointed pipe that is being used in conjunction with the coiled tubing. In the prior art, traditional derricks of drilling rigs have been utilized. However, if a traditional derrick is used along with a coiled tubing unit, a lot of the cost savings associated with using the coiled tubing unit is minimized.

Therefore, there is a need for an apparatus and method that can assist a coiled tubing unit in the drilling, completing, working-over, producing of a well, plug and abandonment of a well, etc. There is also a need for an apparatus and method for performing coiled tubing well intervention operations with jointed tubulars from a platform. These needs, as well as many others, will be apparent from the following description.

SUMMARY OF THE INVENTION

An apparatus for performing well intervention work with coiled tubing and jointed tubulars from a platform is disclosed. The apparatus comprises a modular support frame with a top deck, wherein the deck has a passage therein, and a tower mounted on the top deck. The apparatus further comprises a movable plate positioned within the passage, with the movable plate having a first aperture and a second aperture therein, and a track formed within the passage, and wherein the movable plate is slidingly attached to the track. The apparatus may further comprise a support rotary table disposed within the modular support frame, wherein the support rotary table suspends and rotates the jointed tubulars. The apparatus may further comprise a coiled tubing injector head interface plate operatively attached to the movable plate, and wherein the coiled tubing injector head plate is operatively associated with the first aperture of the movable plate. The coiled tubing injector head interface plate is positioned over the well in a first position.

The apparatus may also include means for moving the movable plate relative to the top deck. The moving means may include a hydraulic piston and a hydraulic supply. In a second position, the rotary support table is positioned over the well, and the second aperture is positioned over the rotary support table. Also, the coiled tubing injector head interface plate, in one embodiment, is laterally movable over the first aperture. The support rotary table may include a slot for entry of the jointed pipe, and wherein the rotary support table supports the joined pipe. In the most preferred embodiment, the tower is a three legged member.

Also disclosed is a method of performing well intervention work with a coiled tubing unit and jointed pipe from a platform, with the platform having a subterranean well extending therefrom. The method includes providing an apparatus, with the apparatus comprising: a modular support frame with a top deck, and wherein the top deck has a passage therein; a tower mounted on said top deck; a movable plate positioned within the passage, the movable plate having a first aperture and a second aperture therein; a coiled tubing injector head interface plate operatively attached to the movable plate, and wherein the coiled tubing injector head plate is positioned over the first aperture of the movable plate; and the interface plate is positioned over the well. The method further comprises moving the moving plate so that the interface plate is no longer positioned over the well, positioning the second aperture over the well, picking-up a first jointed tubular with the tower, moving a rotary table over the well, and lowering the first jointed tubular through the second aperture and into the rotary table with the tower.

The method further comprises picking-up a second jointed tubular with the tower, lowering the second jointed tubular through the second aperture with the tower, making-up the first and the second jointed tubular with the rotary table and lowering the first and the second jointed tubular with the tower into the well. The method further comprises suspending the second jointed tubular within the well, moving the rotary table away from the well, moving the moving plate so that the interface plate is positioned over the well, rigging-up the coiled tubing injector head to the well so that the coiled tubing can be run into the well and performing well intervention work with the coiled tubing and the jointed tubulars.

In one preferred embodiment, the step of making-up the first and the second jointed tubulars includes supporting the jointed pipe within the rotary table disposed within the modular support frame and rotating the second jointed pipe relative to the first jointed pipe in order to make-up the jointed tubular. In yet another embodiment, a track is formed within the passage, and wherein the movable plate is slidingly attached to the track, and the method further comprises sliding the moving plate along the track so that the injector interface plate is in the position over the well and rigging up the coiled tubing injector head to the well.

An advantage of the present invention is that the system disclosed allows an operator to utilize coiled tubing and jointed pipe together in an operational environment. Yet another advantage is that the apparatus can be used on offshore platforms. Yet another advantage is that the well intervention work utilizing the apparatus and method do not require a drilling rig. Still yet another advantage is that rigging up and rigging down of a coiled tubing unit is facilitated.

A feature of the present invention is the tower used for making-up and breaking-down the jointed tubulars. The tower can also be used for supporting the coiled tubing injector head. In the most preferred embodiment, the tower is a tripod. Another feature is that a rotary table is used for making-up and breaking-down the tubular connections. Yet another feature is the movable plate operatively associated within a passage, wherein the movable plate contains a first and second aperture. Another feature includes the track operatively associated with the passage that cooperates with the movable plate to allow movement of the movable plate. Still yet another feature is the interface plate that connects to a coiled tubing injector head, and wherein the interface plate may be used to hold the coiled tubing injector head as well as position the injector in a correct orientation.

In an alternate embodiment, the present invention is directed to an apparatus for performing well intervention operations on a well with a coiled tubing unit and jointed tubulars on land. The apparatus may include a modular support frame with a top deck having a passage therein. The modular support frame may be rotatably mounted on a transport vehicle. The apparatus may also include a tower mounted on the top deck, a movable plate positioned within the passage. The movable plate may have a first aperture and a second aperture therein. The apparatus may further include a track formed within the passage, and the movable plate may be slidingly attached to the track. The apparatus may further include a coiled tubing injector head interface plate operatively attached to the movable plate. The coiled tubing injector head plate may be positioned over the first aperture of the movable plate. In a first position, the coiled tubing injector head interface plate may be positioned over the well.

The apparatus may further include a lifting mechanism having a first end and a second end. The first end may be rotatably attached to the transport vehicle and the second end may be rotatably attached to the modular support frame. The lifting mechanism may be capable of moving the modular support frame between a transport position and an upright position.

The apparatus may further include one or more frame expansion mechanisms having a retracted position and an expanded position. Each of the frame expansion mechanisms may be capable of vertically displacing a portion of the modular support frame when activated by moving from the retracted position to the expanded position. The apparatus may further include one or more frame locking mechanisms having a disengaged position and an engaged position. Each of the frame locking mechanisms may be capable of locking a frame expansion mechanism in the expanded position when the frame locking mechanisms is activated by moving from the disengaged position to the engaged position.

The apparatus may further include one or more tower expansion mechanisms. Each tower expansion mechanisms may be capable of vertically displacing a portion of the tower when activated. The apparatus may further include one or more tower locking mechanisms having a disengaged position and an engaged position. Each tower locking mechanism may be capable of locking a tower expansion mechanism in the expanded position when the tower locking mechanism is activated by moving from the disengaged position to the engaged position.

The second aperture of the movable plate may be positioned over the well in a second position. The coiled tubing injector head interface plate may be laterally movable over the first aperture.

In yet another embodiment, the present invention may be directed to an apparatus for performing well intervention work to a well with coiled tubing and jointed tubulars on land. The apparatus may include a modular support frame with a top deck. The modular support frame may be mounted on a transport vehicle. The top deck may have a passage therein. The apparatus may also include a tower mounted on the top deck, and a movable plate positioned within the passage. The movable plate may have a first aperture and a second aperture therein. The apparatus may further include a track formed within the passage. The movable plate may be slidingly attached to the track.

The apparatus may further include a lifting mechanism having a first end and a second end. The first end may be rotatably attached to the transport vehicle, and the second end may be rotatably attached to the modular support frame. The lifting mechanism may be capable of lifting the modular support frame from a transport position to an upright position. The lifting mechanism may be capable of lowering the modular support frame from the upright position to the transport position. The lifting mechanism may include a hydraulic cylinder and a telescoping member. The apparatus may further include a hydraulic supply in hydraulic communication with the hydraulic cylinder.

The apparatus may further include a coiled tubing injector head interface plate operatively attached to the movable plate. The coiled tubing injector head plate may be positioned over the first aperture of the movable plate. In a first position, the first aperture may be positioned over the well. In a second position, the second aperture may be positioned over the well.

In another embodiment, the present invention is directed to a method of performing well intervention work with a coiled tubing unit and jointed tubulars on land. The method may include the following steps: (1) providing an apparatus having: a modular support frame with a top deck having a passage therein; a tower mounted on the top deck; a movable plate positioned within the passage, the movable plate having a first aperture and a second aperture therein; a coiled tubing injector head interface plate operatively attached to the movable plate, the coiled tubing injector head plate positioned over the first aperture of the movable plate; (2) rotatably attaching the modular support frame to a transport vehicle such that the apparatus is in a transport position on the transport vehicle; (3) rotatably attaching a first end of a lifting mechanism to the transport vehicle, and rotatably attaching a second end of the lifting mechanism to the modular support frame; (4) transporting the apparatus to a well site on the transport vehicle; (5) positioning the transport vehicle in a work area near a well; and (6) lifting the apparatus from the transport position to an upright position over the well using the lifting mechanism.

The method may further include the following steps: (7) moving the movable plate such that the second aperture is positioned over the well; (8) lifting a first jointed tubular with the tower; (9) moving a rotary table over the well; (10) lowering the first jointed tubular through the second aperture and into the rotary table using the tower; (11) lifting a second jointed tubular with the tower; (12) lowering the second jointed tubular through the second aperture with the tower; (12) making-up the first and the second jointed tubulars with the rotary table; (14) lowering the first and the second jointed tubulars with the tower into the well; (15) suspending the first and the second jointed tubular within the well; (16) moving the rotary table out of line with the well; (17) moving the movable plate such that the coiled tubing injector head interface plate and the first aperture are positioned over the well; (18) rigging-up a coiled tubing injector head to the well for running a coiled tubing into the well; and (19) performing well intervention work with the coiled tubing and the first and the second jointed tubulars.

The method may further include the following steps: (20) lowering the apparatus from the upright position to the transport position using the lifting mechanism; and (21) transporting the apparatus on the transport vehicle away from the well site.

DETAILED DESCRIPTION OF THE PREFERRED EMBODIMENTS

Figure 1:
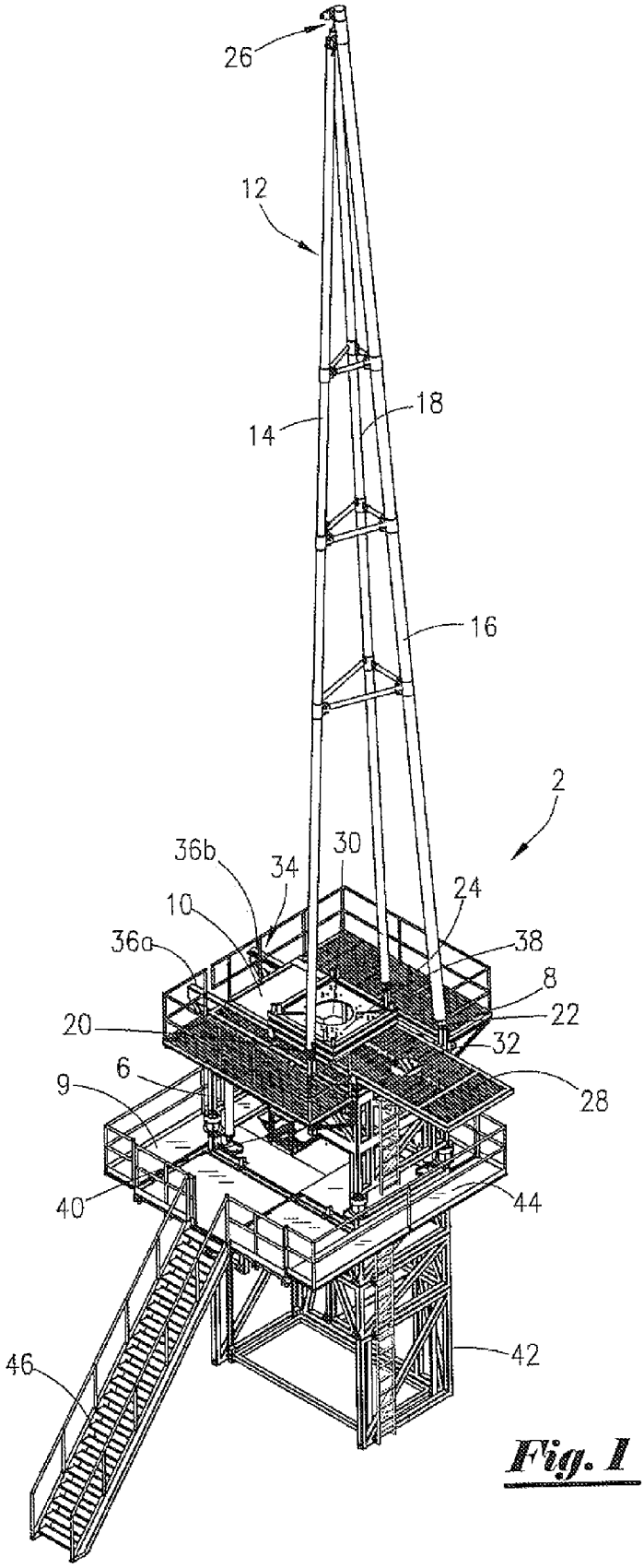
FIG. 1 is a schematic illustration of the most preferred embodiment of the present disclosure.

Referring now to FIG. 1, a schematic illustration of the most preferred embodiment of the present disclosure will now be disclosed. In FIG. 1, the apparatus 2 is situated on a platform (not shown in this view), and wherein the apparatus 2 is capable of performing well intervention operations with a coiled tubing unit (the coiled tubing unit not seen in this view). The apparatus 2 includes a modular support frame 6 with a top deck 8 and bottom deck 9, and wherein the top deck has a passage 10 therein. The apparatus 2 further includes a tower 12 mounted on the top deck 8.

As seen in FIG. 1, in the most preferred embodiment, the tower 12 is a three legged member (sometimes referred to as a tripod 12). The tower 12 includes leg 14, leg 16, and leg 18. Leg 14 is attached to the top deck 8 at 20; leg 16 is attached to the top deck at 22; leg 18 is attached to the top deck 8 at 24. A pulley means 26 is located at the apex of the tower 12, and wherein the pulley means 26 can be used for lifting and lowering various devices, and in particular for lifting and lowering the jointed tubulars, as will be more fully explained later in the disclosure. The tower 12 can also be used to support the coiled tubing injector head.

FIG. 1 also depicts the movable plate 28 positioned within the passage 10, with the movable plate 28 having a first aperture 30 and a second aperture 32 formed therein. A track 34, which comprises a pair of rails 36*a* and 36*b*, are formed within the passage 10 as seen in FIG. 1. The movable plate 28 is slidingly attached to the track 34, and more specifically the movable plate 28 is attached to the rails 36*a*, 36*b*.

A coiled tubing injector head interface plate, seen generally at 38, is operatively attached to the movable plate 28. More specifically, the coiled tubing injector head plate 38 is positioned over and operatively attached to the first aperture 30 of the movable plate 28. In a first position, the coiled tubing injector head interface plate 38 is positioned over the well.

FIG. 1 also depicts the support rotary table 40 disposed within the modular support frame 6, with the support rotary table 40 being capable of rolling into a position (second position) over the well (the well not seen in this view). In operation, the support rotary table 40 will suspend and rotate the jointed tubulars in order to make-up the jointed tubular connections. The support rotary table 40 will also be able to break (i.e. unscrew) the connections, as well understood by those of ordinary skill in the art. In the first position, the coiled tubing injector head interface plate 38 is positioned over the well.

FIG. 1 also depicts the bottom support frame 42, wherein the bottom support frame 42 may be placed on a platform (platform not shown in this view). For instance, the platform may be an offshore platform, and the support frame 42, modular support frame 6 and top deck 8 may be positioned on the platform. Hence, the apparatus 2 is modular and transportable to various remote areas such as offshore platforms. Additionally, FIG. 1 illustrates the walking deck 44 which surrounds the bottom support frame 42, and wherein the walking deck 44 allows for an area for walking as well as a work deck. A stairwell 46 is also provided for allowing walking access from the platform (not shown in this view) to the apparatus 2.

Figure 2:
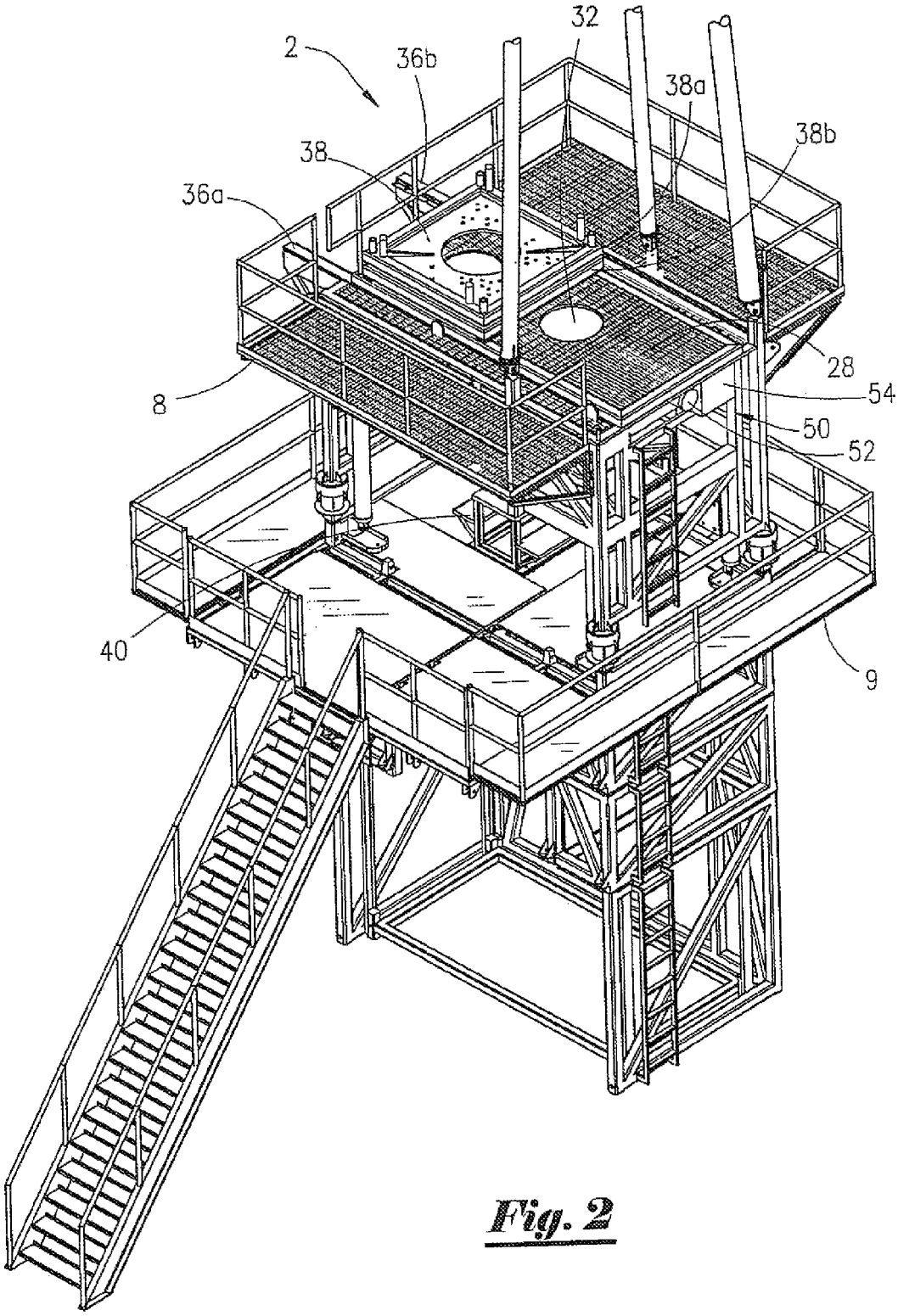
FIG. 2 is an enlarged view of the apparatus seen in FIG. 1.

Referring now to FIG. 2, an enlarged view of the apparatus 2 seen in FIG. 1 will now be described. It should be noted that like numbers appearing in the various figures refer to like components. FIG. 2 depicts a sequential view in that the moveable plate 28 has moved to a second position so that the second aperture 32 is positioned over the well and the support rotary table 40 is also over the well. In other words, in the second position, the second aperture 32 is positioned over the well in FIG. 2, and the support rotary table 40, positioned on the bottom deck 9, is also over the well. As per the teachings of this invention, the operator will be able to lift and lower the jointed tubular members thru the aperture 32 and into engagement with the support rotary table 40. The support rotary table 40 can be moved by rollers operatively associated with a track on the deck 9.

The moveable plate 28 is operatively associated with rails 36*a*, 36*b*, and wherein the moving means 50 for moving the plate 28 relative to the top deck 8 is shown. The moving means 50 will consist of a hydraulic cylinder with piston, seen generally at 52, as well as a hydraulic supply 54 means for supply hydraulic fluid under pressure to the cylinder with piston 52.

FIG. 2 also depicts the interface plate 38. In the most preferred embodiment, the interface plate 38 is generally a pair of plates 38*a*, 38*b* situated one on top of the other, and wherein the plates are laterally movable. The lateral movement of the plate allows an operator to manipulate the exact position of the coiled tubing injector head for assisting in rigging-up and rigging-down procedures of the coiled tubing injector head.

Figure 3:
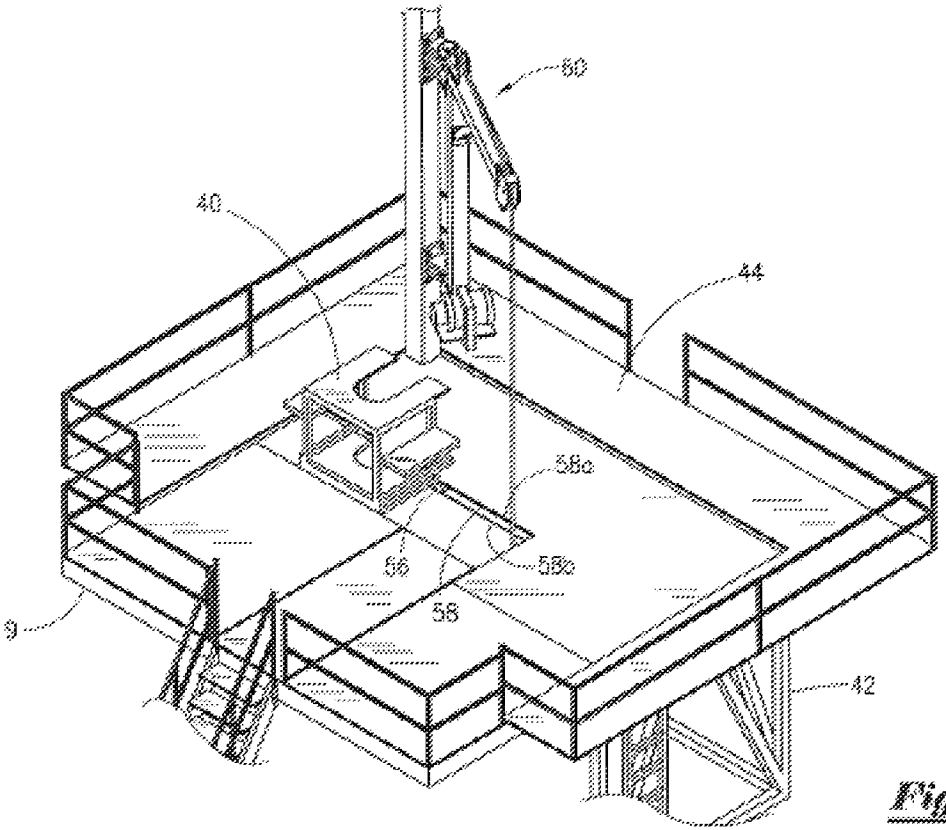
FIG. 3 is a partial view of the apparatus seen in FIG. 1 depicting the rotary table on the intermediate deck.

Referring now to FIG. 3, a partial view of the apparatus 2 seen in FIGS. 1 and 2 depicting the support rotary table 40 on the bottom deck 9 of the modular support frame 6 will now be described. The rollers 56 are operatively associated with the tracks 58*a*, 58*b*, wherein the rollers 56 can be used to roll the support rotary table 40 over the well. As noted earlier, the support rotary table 40 is positioned over the well in the second position. The support rotary table 40 may have operatively associated therewith a set of slips for supporting the jointed pipe during make-up and break-out. The support rotary table 40 may include a driver for providing torque to make-up and break-down the jointed pipe as well understood by those of ordinary skill in the art. A support rotary table 40 is commercially available from National Oilwell Varco Corporation under the name False Rotary Table. The support rotary table 40 is sometimes referred to as a false rotary since rotary tables on drilling rigs are not moveable.

Additionally, FIG. 3 depicts the swing arm crane 60, wherein the swing arm crane 60 can be used for various rigging-up and rigging-down operations. The swing arm crane 60 is described in U.S. Pat. No. 7,096,963, entitled "Swing Arm Crane and Method", which is incorporated herein by express reference.

Figure 4:
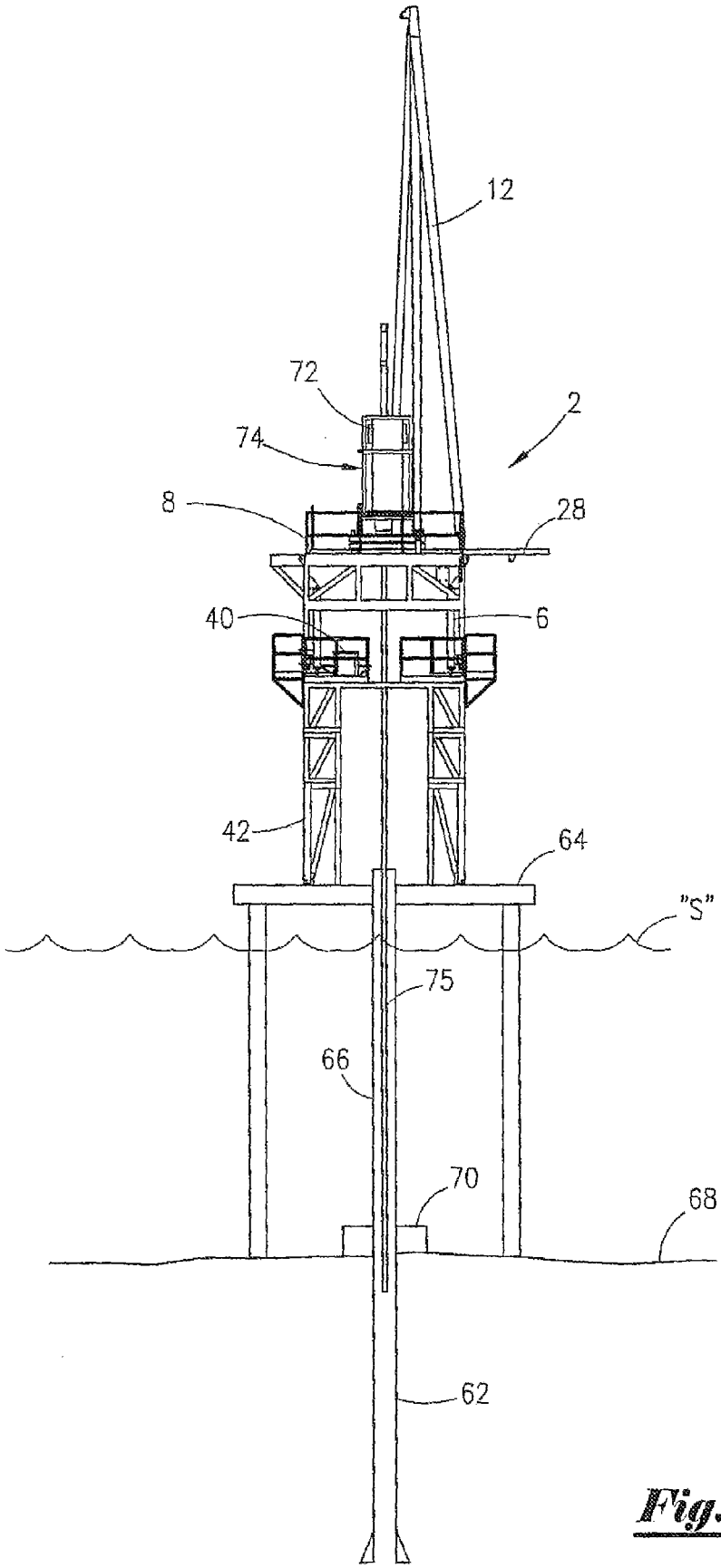
FIG. 4 is a schematic of the present apparatus positioned over a well.

Referring now to FIG. 4, a schematic of the present apparatus 2 positioned over a subterranean well 62 will now be described. The apparatus 2 is situated on a platform 64, and wherein the platform 64 is in offshore waters. The surface of the water is denoted as "S". As understood by those of ordinary skill in the art, a marine riser 66 extends from the sea floor 68 to the platform 64. A sub-sea tree 70 connects the marine riser 66 to the well 62. Hence, the coiled tubing and jointed pipe operations occur concentrically within the marine riser 66 and well 62 as very well understood by those of ordinary skill in the art. The operations may include well intervention procedures such as workovers, completions, plug and abandonments, etc. The moving plate 28 is in the first position such that the coiled tubing injector head 72 of the coil tubing unit 74 is positioned over the well 62. The coiled tubing tubular 75 is shown disposed within the riser 66 and well 62. Note that the coil tubing unit 74 is situated on the top deck 8. The support rotary table 40 is in the first position.

Figure 5:
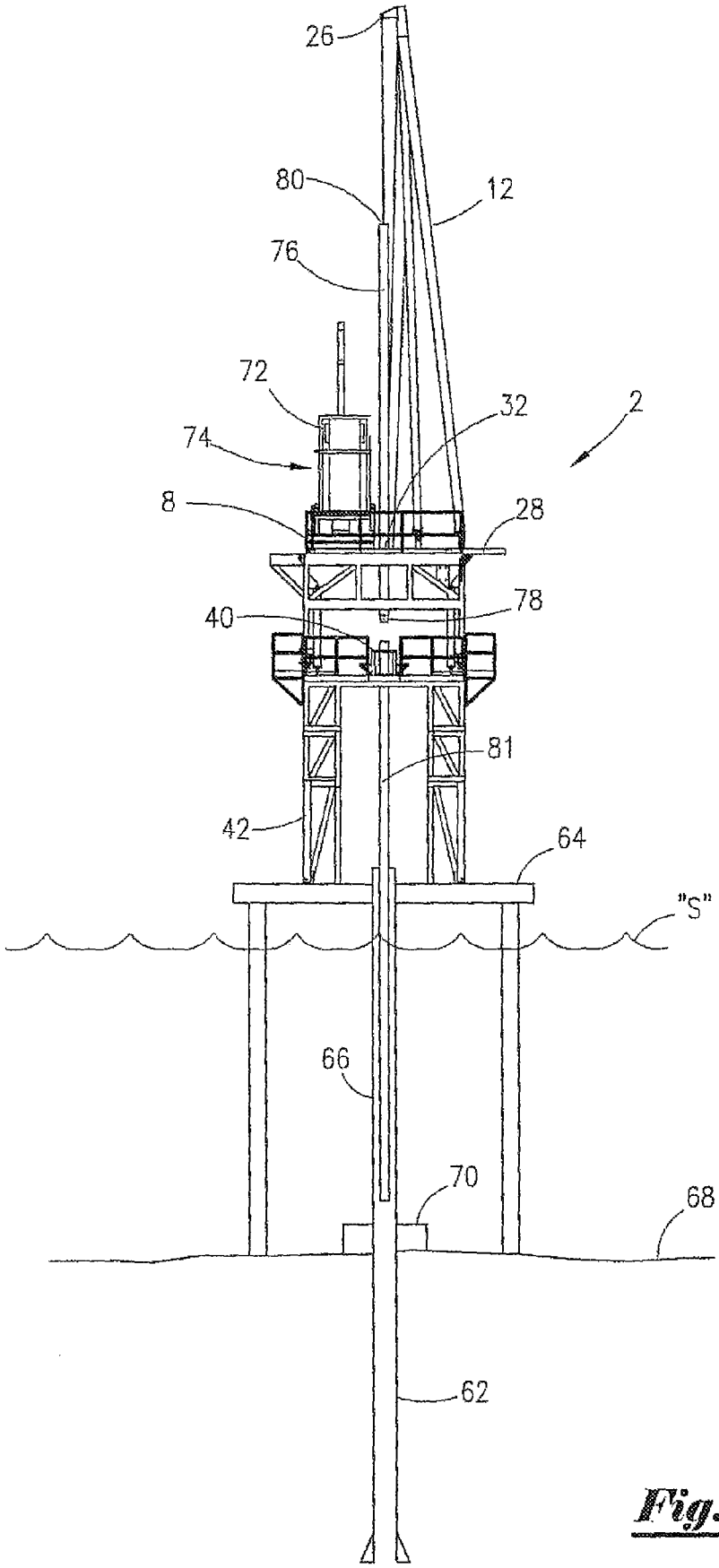
FIG. 5 is a sequential schematic of the apparatus seen in FIG. 4, with the moving plate being moved for insertion of jointed tubulars into the well.

FIG. 5 is a sequential schematic of the apparatus 2 seen in FIG. 4, with the moving plate 28 being moved for insertion of jointed tubulars (such as pipe member 76) into the well 62. In other words, the moving means has been activated, and the movable plate 28 has shifted. The support rotary table 40 is over the well and the second aperture 32 is over the support rotary table 40 (i.e. the second position). It should be noted that the pipe member 76 has a pin (threaded) end 78 and box end 80. Hence, the tower 12 is used to lift a pipe member 76 via pulley means 26, and then the pipe member 76 is inserted thru the second aperture 32. The pipe member 81 is supported within the support rotary table 40, and wherein the jointed tubulars (76 and 81) can be made-up utilizing the support rotary table 40 and the jointed tubulars (76 and 81) can be lowered into the well 62. After utilizing the jointed tubulars in the manner desired by the operator, the rotary support table 40 is rolled away from the well, the moveable plate 28 can be moved again, and the coiled tubing injector head 72 and coiled tubing unit 74 can be rigged-up over the well 62 for continuation of the desired well intervention work. In other words, the coiled tubing injector head 72 is operatively rigged-up to the well so that the coiled tubing can be run into the well (as seen in FIG. 4).

Apparatus 2 is modular and transportable to various remote locations such as offshore platforms or land well sites. FIGS. 4 and 5 show apparatus 2 positioned on an offshore platform. Other embodiments of apparatus 2 may be positioned over a wellbore on land.

Figure 6:
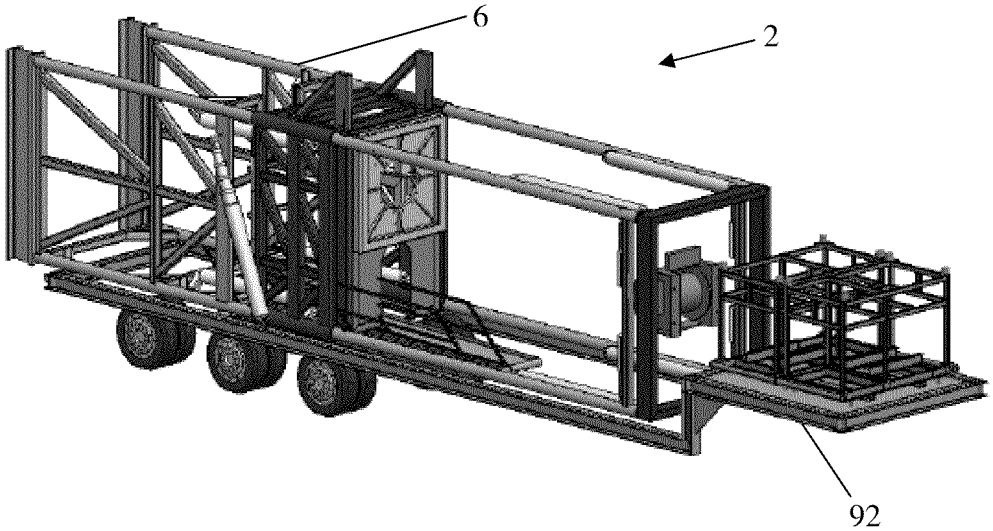
FIG. 6 is an isometric view of one embodiment of the present apparatus loaded on a transport vehicle in a transport position.
Figure 7:
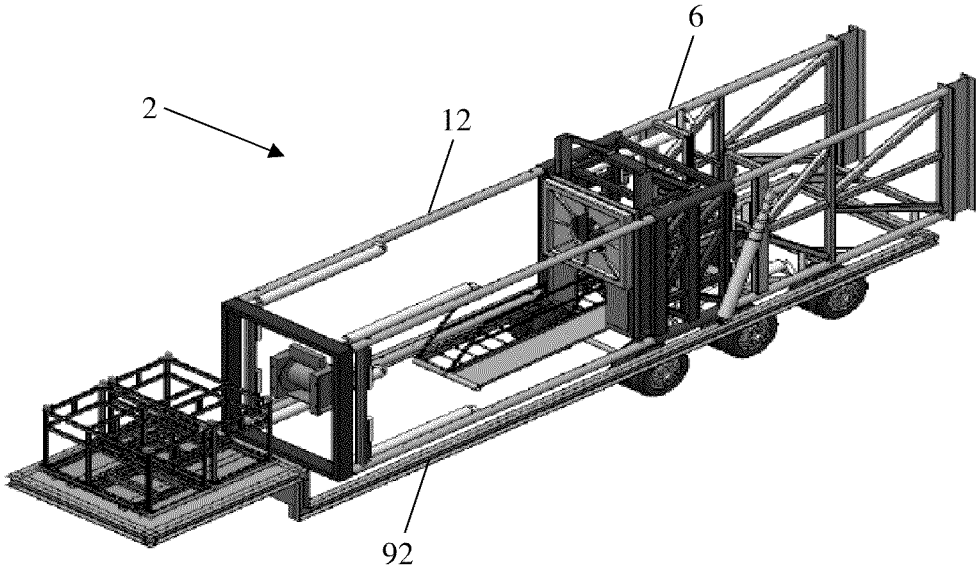
FIG. 7 is an isometric view of the present apparatus loaded on a transport vehicle in a transport position.

FIGS. 6 and 7 illustrate another embodiment of apparatus 2 mounted on transport vehicle 92. Transport vehicle 92 may be a trailer as shown, which may be pulled by a tractor (not shown) as well understood in the art. Apparatus 2 may be capable of performing well intervention operations with a coiled tubing unit.

Figure 8:
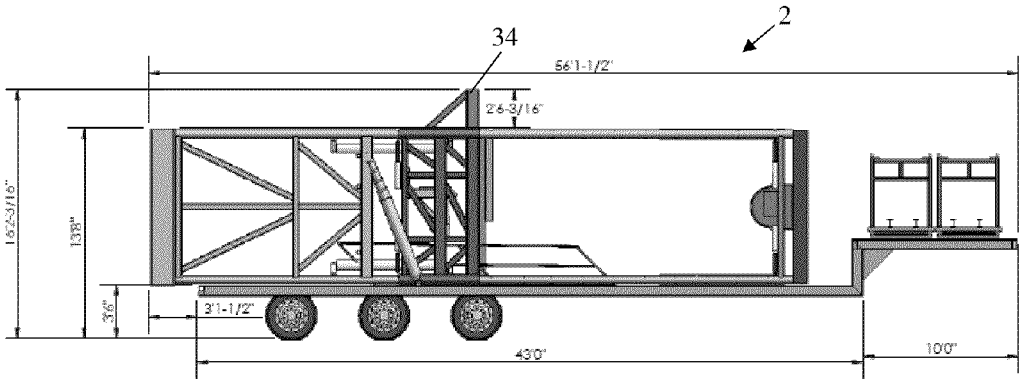
FIG. 8 is a front view of the present apparatus loaded on a transport vehicle in a transport position.
Figure 9:
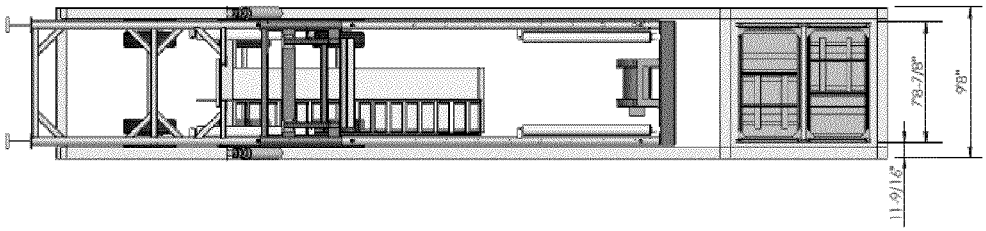
FIG. 9 is a top view of the present apparatus loaded on a transport vehicle in a transport position.
Figure 10:
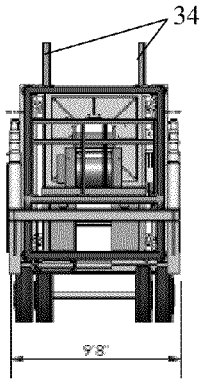
FIG. 10 is a side view of the present apparatus loaded on a transport vehicle in a transport position.

In FIGS. 8-10, apparatus 2 is positioned in a transport position on transport vehicle 92 for moving apparatus 2 to a well site on land. Because track 34 extends above the remainder of apparatus 2 in the transport position, it may be removed during transit to more adequately accommodate transportation on roadways.

Figure 11:
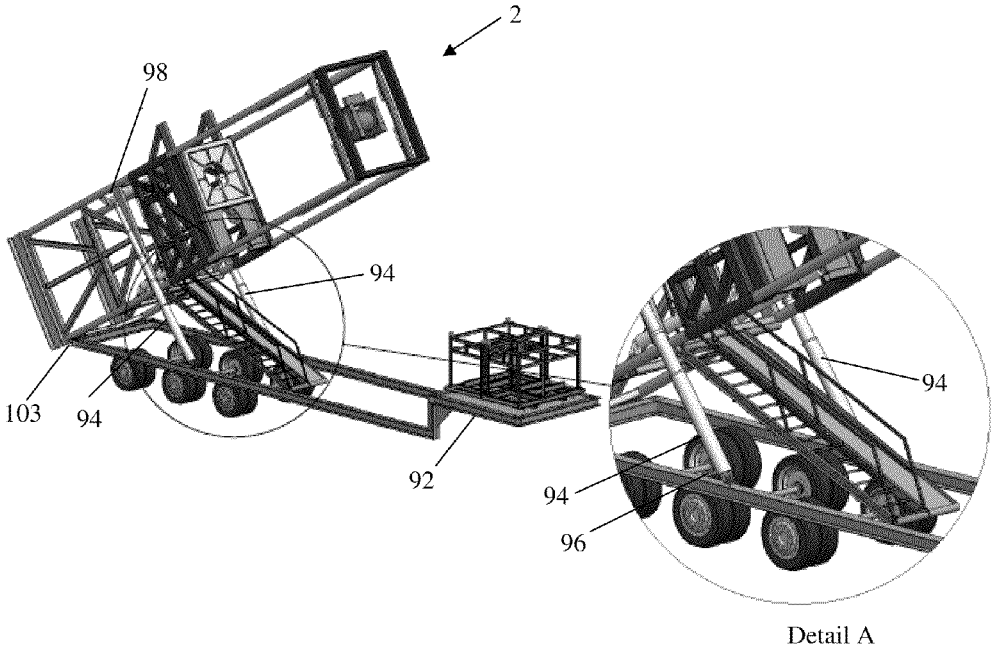
FIG. 11 is a sequential isometric view of the present apparatus illustrated in FIG. 6 in the process of being lifted to an upright position.
Figure 12:
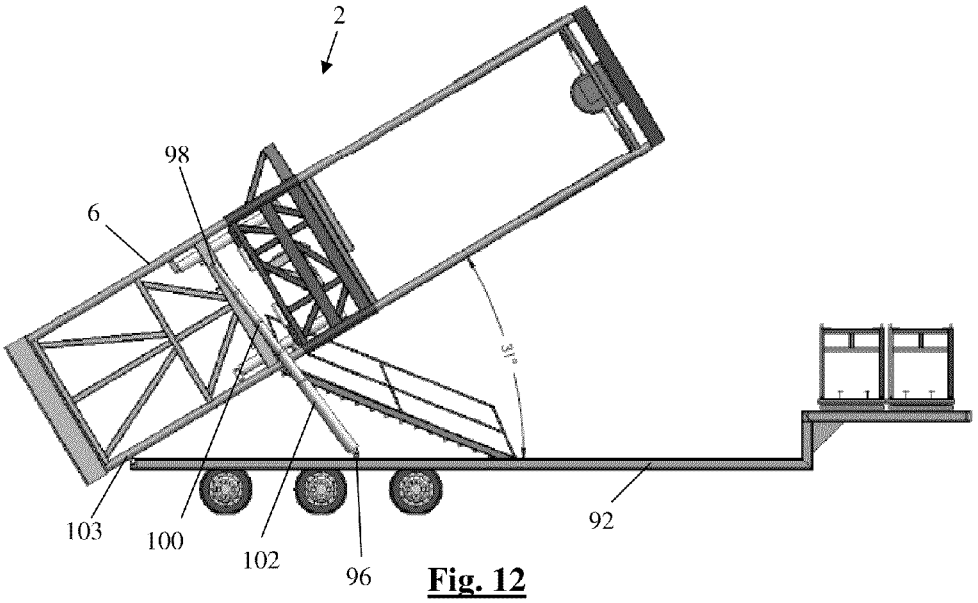
FIG. 12 is a front view of the present apparatus illustrated in FIG. 11 in the process of being lifted to the upright position.

Referring now to FIGS. 11 and 12, transport vehicle 92 may include at least one lifting mechanism 94. First end 96 of each lifting mechanism 94 may be rotatably attached to transport vehicle 92. Second end 98 of each lifting mechanism 94 may be rotatably attached to apparatus 2. The attachment point of second end 98 to apparatus 2 may be on modular support frame 6. Lifting mechanism 94 may include telescoping arm 100 and hydraulic cylinder 102, which may work together to lift and lower apparatus 2 between the transport position and an upright position. Transport vehicle 92 may include a power generation assembly for generating hydraulic pressure in hydraulic cylinder 102 for moving apparatus 2 between the transport position and the upright position. Apparatus 2 may be rotatably attached to transport vehicle 92 at secondary attachment points 103.

For transit, apparatus 2 may be loaded on transport vehicle 92 in the transport position as shown in FIGS. 6-10. Apparatus 2 may be transported on most roads and highways in this configuration. At a well site, lifting mechanism 94 may be used to lift or tilt apparatus 2 as shown in FIGS. 11 and 12. Telescoping arm 100 continues to extend from within hydraulic cylinder 102 until apparatus 2 is in the collapsed upright position.

Figure 13:
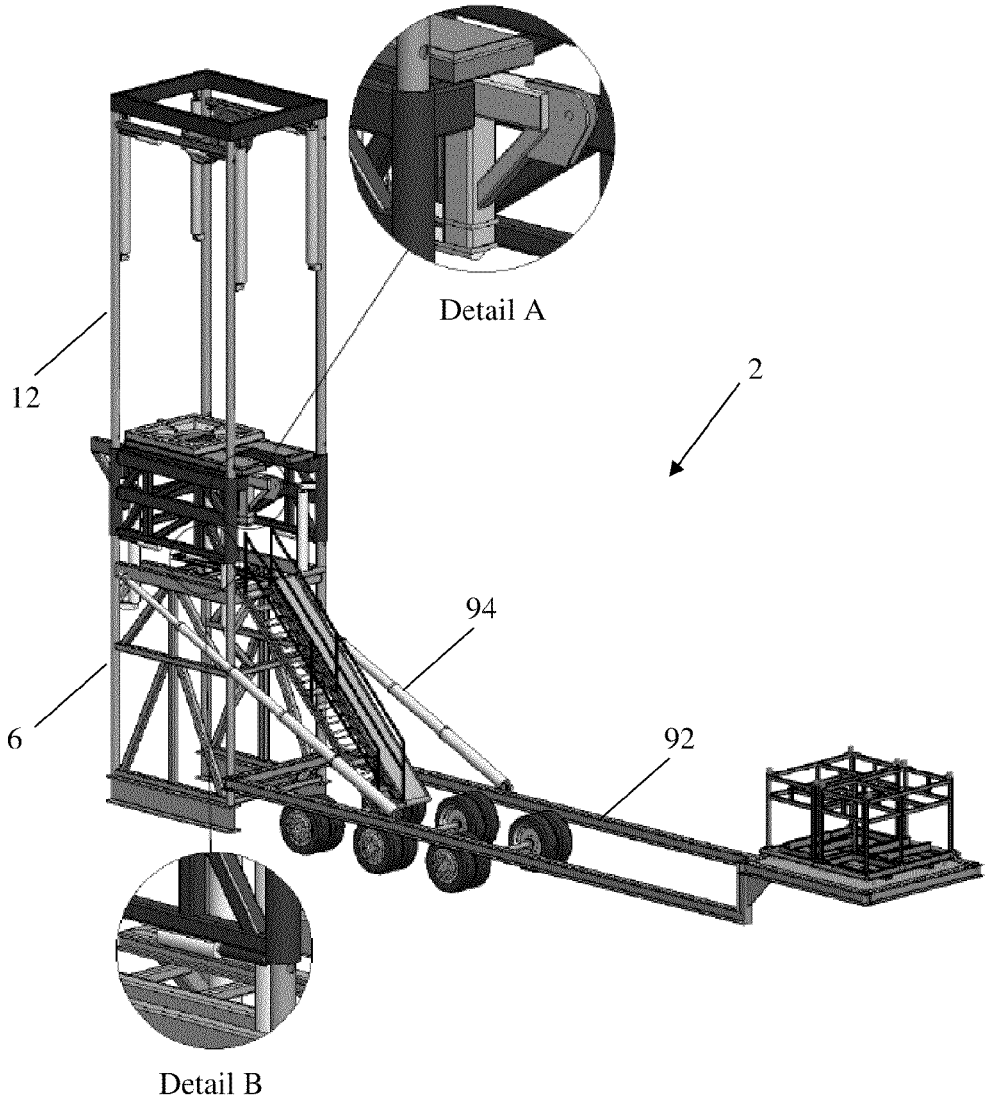
FIG. 13 is a sequential schematic of the present apparatus illustrated in FIG. 11 in the collapsed upright position.
Figure 14:
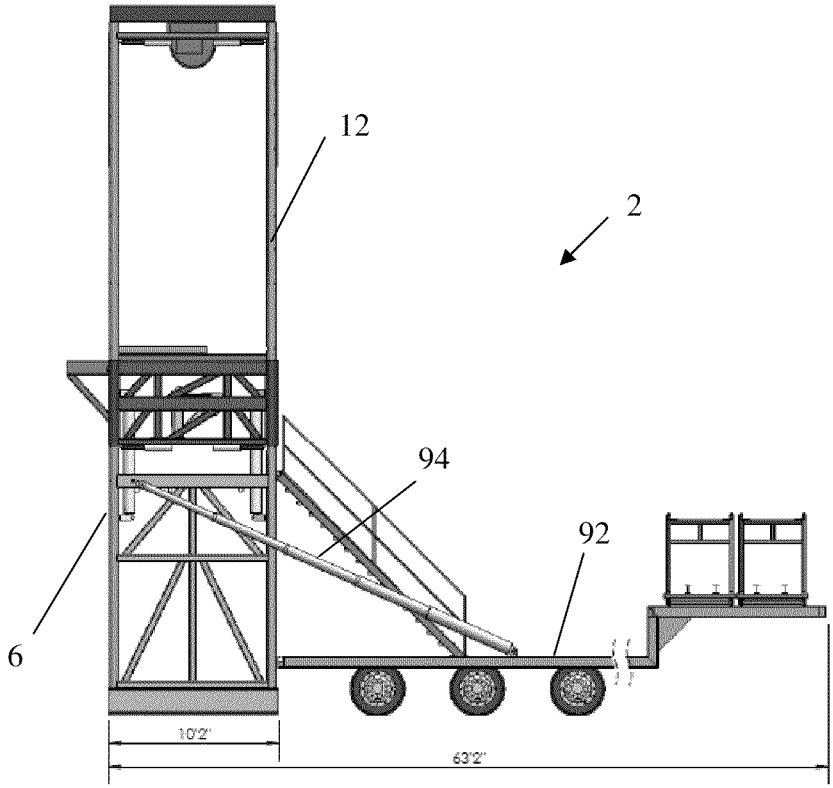
FIG. 14 is a front view of the present apparatus illustrated in FIG. 13 in the collapsed upright position.
Figure 15:
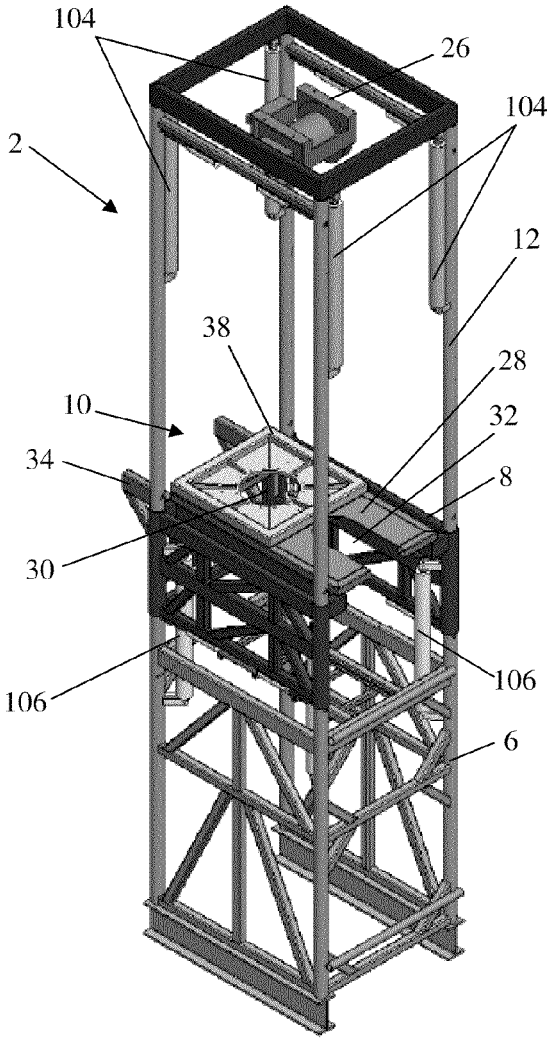
FIG. 15 is an isometric view of the modular support frame and tower that are mounted to the transport vehicle as illustrated in FIGS. 6-14.

FIGS. 13 and 14 illustrate apparatus 2 in the collapsed upright position, in which the bottom end of modular support frame 6 is on the ground. The wheels of transport vehicle 92 may be locked if necessary. Apparatus 2 may be detached from transport vehicle 92 when in the desired position. Alternatively, apparatus 2 may remain attached to transport vehicle 92 throughout the course of the well work.

Figure 16:
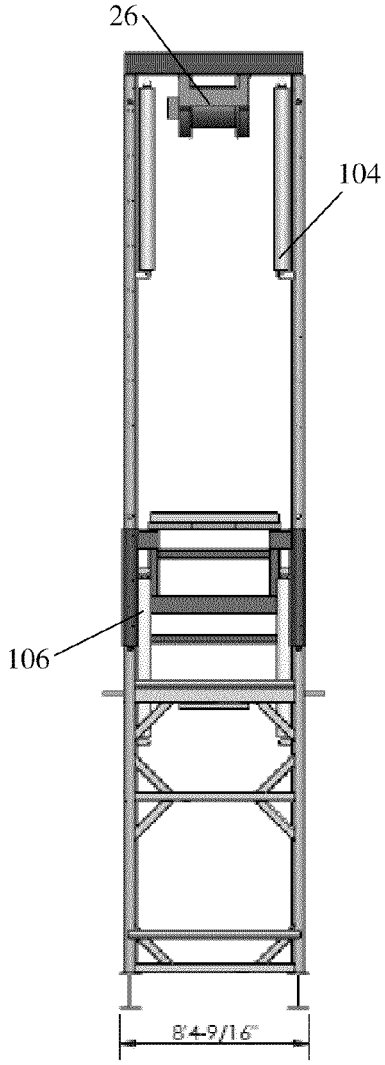
FIG. 16 is a side view of the modular support frame and tower illustrated in FIG. 15.
Figure 17:
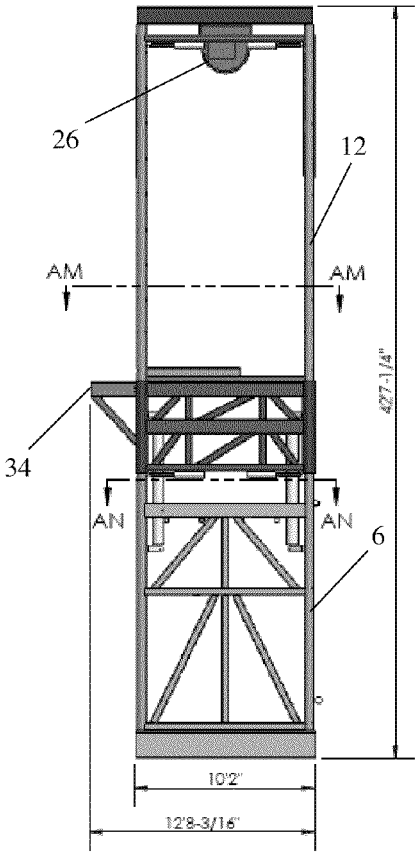
FIG. 17 is a front view of the modular support frame and tower illustrated in FIGS. 15-16.
Figure 18:
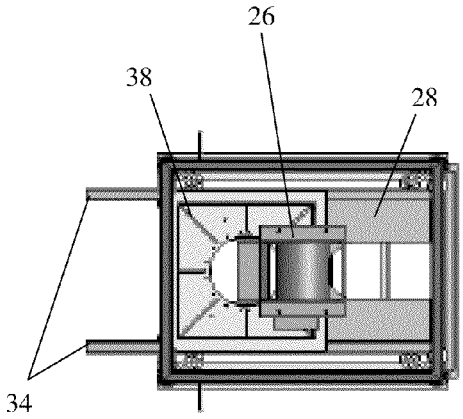
FIG. 18 is a top view of the modular support frame and tower illustrated in FIGS. 15-17.
Figure 19:
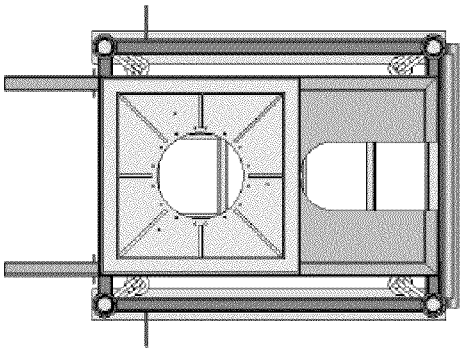
FIG. 19 is a cross-sectional view of the modular support frame and tower of FIG. 17 taken along plane AM-AM.
Figure 20:
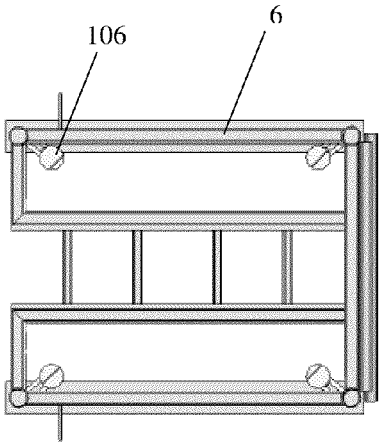
FIG. 20 is a cross-sectional view of the modular support frame and tower of FIG. 17 taken along plane AN-AN.

FIGS. 15-20 illustrate apparatus 2 in the collapsed upright position detached from transport vehicle 92. FIG. 16 is a side view of apparatus 2. FIG. 17 is a front view of apparatus 2. FIG. 18 is a top view of apparatus 2. FIG. 19 is a cross-sectional view of apparatus 2 in FIG. 17 taken along plane AM-AM. FIG. 20 is a cross-sectional view of apparatus 2 in FIG. 17 taken along plane AN-AN. Apparatus 2 may include modular support frame 6 with top deck 8 having passage 10 therein. Apparatus 2 may also include tower 12 mounted on top deck 8. In this embodiment, tower 12 may be a four-legged structure. Pulley means 26 may be positioned at the upper end of tower 12. As in the embodiments described above, pulley means 26 may be used for lifting and lowering various devices, e.g. lifting and lowering jointed tubulars or supporting the coiled tubing injector head.

Referring still to FIGS. 15-20, movable plate 28 may be positioned within passage 10. Movable plate 28 may have first aperture 30 and second aperture 32 formed therein. Coiled tubing injector head interface plate 38 may be operatively attached to movable plate 28 over first aperture 30. Movable plate 28 may be slidingly attached to track 34. In the same way as the described above in connection with the other embodiments, coiled tubing injector head interface plate 38 (and first aperture 30 of movable plate 28) may be positioned over the wellbore in the first position for running coiled tubing into the wellbore. In the second position, aperture 32 of movable plate may be positioned over the wellbore for running jointed tubulars into the wellbore. In this embodiment, apparatus 2 may further include one or more upper expansion mechanisms 104 and one or more lower expansion mechanisms 106. Upper and lower expansion mechanisms 104, 106 may be hydraulic or pneumatic cylinders, and may be multi-stage or single-stage cylinders. Alternatively, upper and lower expansion mechanisms 104, 106 may be any type of mechanism capable of vertically displacing one part of apparatus 2 from another part of apparatus 2.

Figure 21:
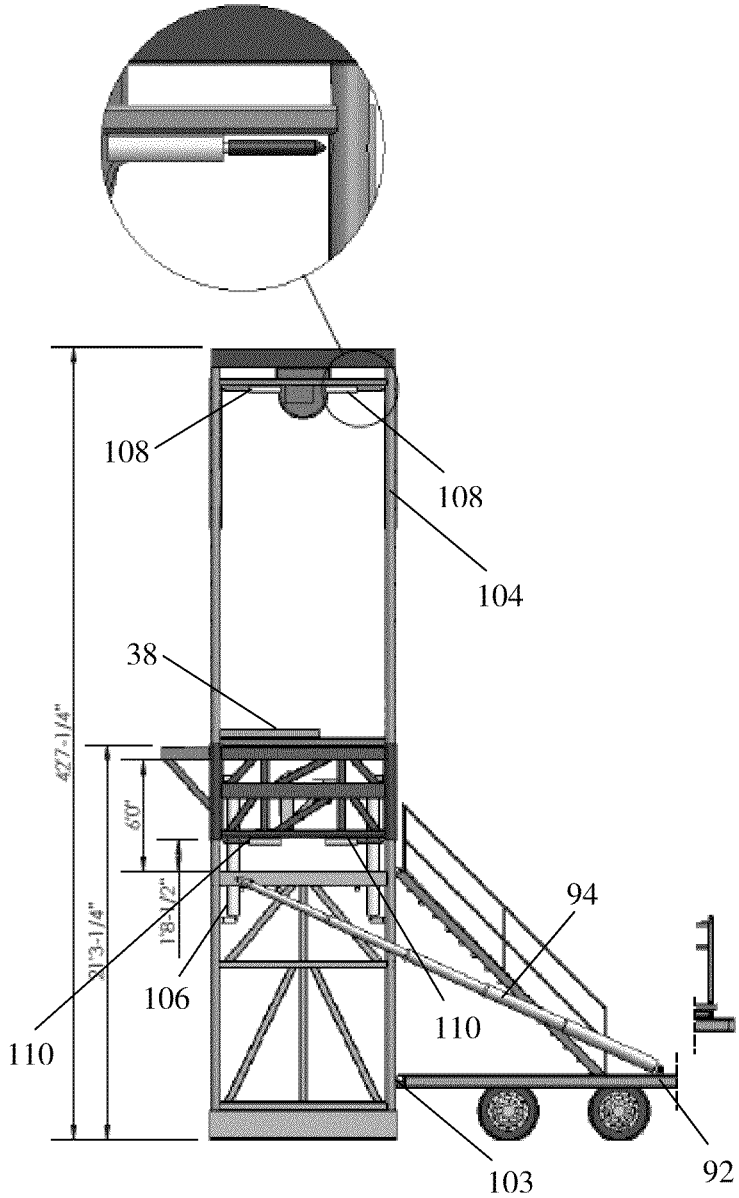
FIG. 21 is a front view of the present apparatus in the collapsed upright position.
Figure 22:
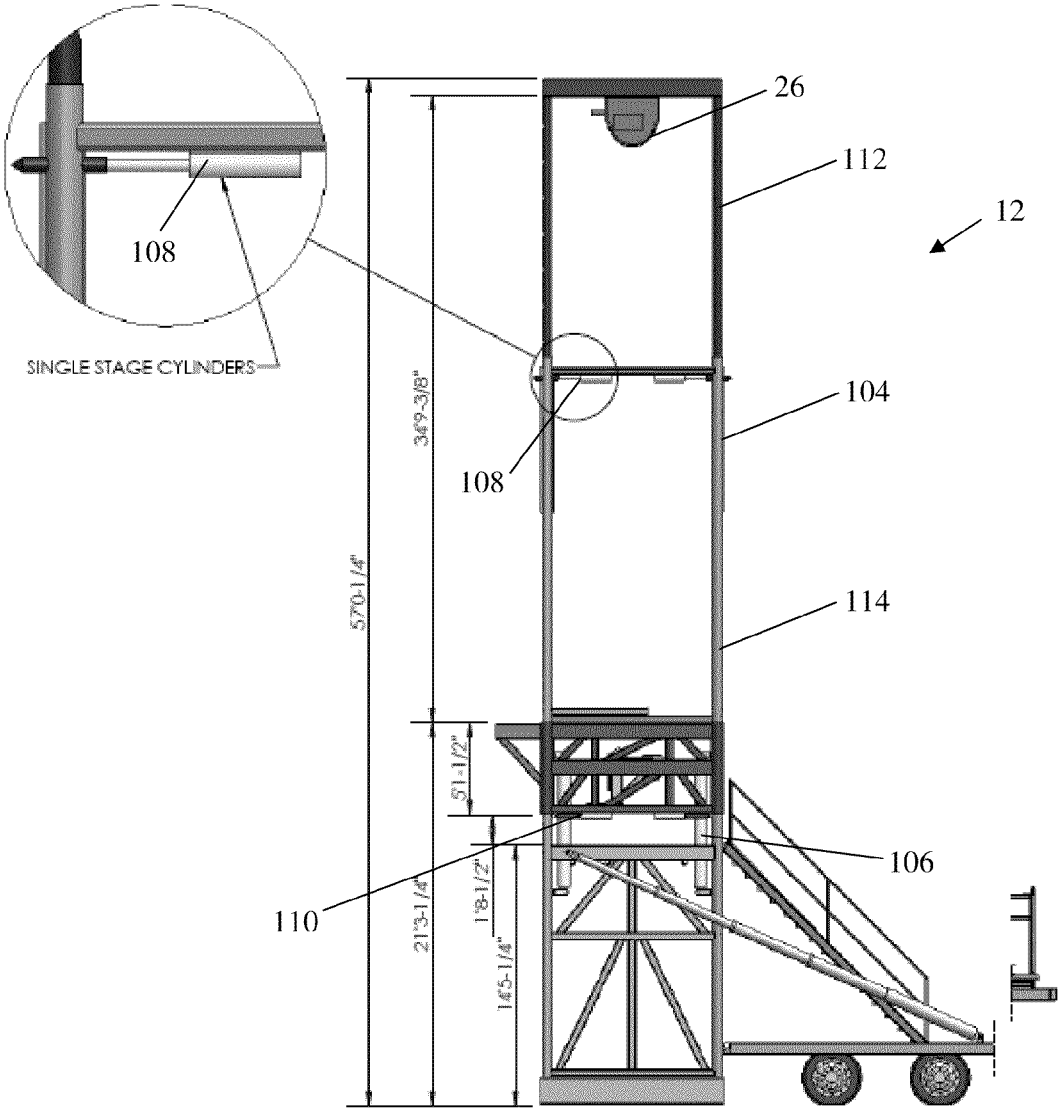
FIG. 22 is a front view of the present apparatus in the half-expanded upright position.
Figure 23:
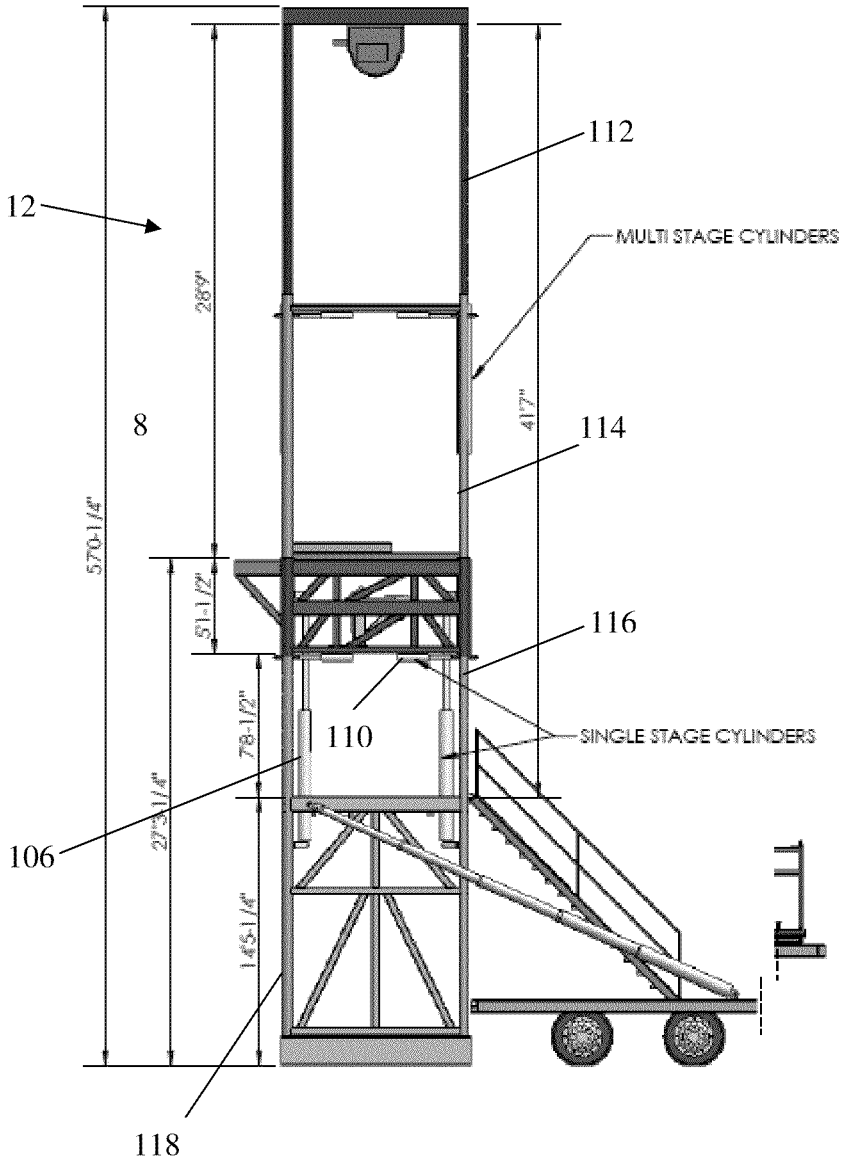
FIG. 23 is a front view of the present apparatus in the expanded upright position.

FIGS. 21-23 illustrate apparatus 2 in varying upright positions while remaining attached to transport vehicle 92 at secondary attachment points 104 and through lifting mechanism 94. In FIG. 21, apparatus 2 is in the collapsed upright position. In this position, apparatus 2 has been lifted from the transport position. Upper and lower expansion mechanisms 104, 106 are all in a retracted position. In the collapsed upright position, apparatus 2 has a minimum height. Apparatus 2 may further include one or more upper locking mechanisms 108 and one or more lower locking mechanisms 110, which may each be capable of locking an upper expansion mechanism 104 or a lower expansion mechanism 106, respectively, into an expanded position. In the collapsed upright position of apparatus 2, upper and lower locking mechanisms 108, 110 may be in a retracted position.

In FIG. 22, apparatus 2 is in the half-expanded upright position. In this position, upper expansion mechanisms 104 have been moved to an expanded position thereby vertically telescoping upper frame 112 of tower 12 upward from lower frame 114 of tower 12. Upper locking mechanisms 108 may engage and lock upper expansion mechanisms 104 into the expanded position. In this way upper frame 112 may be secured in the half-expanded upright position. Lower expansion mechanisms 106 and lower locking mechanisms 110 may remain in the retracted position. Alternatively, the half-expanded upright position of apparatus 2 may include lower expanding mechanisms 106 and lower locking mechanisms 110 in an expanded position, and upper expanding mechanisms 104 and upper locking mechanisms 108 in a retracted position.

In FIG. 23, apparatus 2 is in the expanded upright position. In this position, lower expansion mechanisms 106 have been moved to an expanded position thereby vertically telescoping upper frame 116 of modular support frame 6 (including top deck 8) upward from lower frame 118 of modular support frame 6. Lower locking mechanisms 110 may engage and lock lower expansion mechanisms 106 into the expanded position. In this way upper frame 116 (including top deck 8) may be secured in the expanded upright position. In this configuration, apparatus 2 has a maximum height.

When the work is completed at the well site, upper and lower locking mechanisms 108, 110 may be disengaged from upper and lower expansion mechanisms 104, 106, allowing upper and lower expansion mechanisms 104, 106 to move from the expanded position into the retracted position. In this way, apparatus 2 in the expanded upright position may be placed in the collapsed upright position. Thereafter, lifting mechanism 94 may be used to lower apparatus 2 to the transport position on transport vehicle 92. Transport vehicle 92 may be used to move expanding apparatus to another location.

Although the disclosure has been described and illustrated in certain preferred embodiments of the invention, it is to be understood that the invention is not restricted to these particular embodiments. Rather, the invention includes all embodiments, which are functional, or mechanical embodiments of the specific embodiments and features that have been described and illustrated herein.

We claim:

1. An apparatus for performing well intervention operations on a well with a coiled tubing unit and jointed tubulars on land, the apparatus comprising:

a modular support frame with a top deck, and wherein said top deck has a passage therein, said modular support frame pivotally mounted on a transport vehicle;

a tower mounted on said top deck;

a movable plate positioned within said passage, said movable plate having a first aperture;

a track formed within the passage, and wherein said movable plate is slidingly attached to said track;

a coiled tubing injector head interface plate operatively attached to the movable plate, and wherein said coiled tubing injector head plate is positioned over said first aperture of said movable plate, and in a first position, said coiled tubing injector head interface plate is positioned over the well;

a lifting mechanism comprising a first end and a second end, wherein the first end is operatively attached to the transport vehicle and the second end is operatively attached to the modular support frame, and wherein the lifting mechanism is capable of moving the modular support frame between a transport position and an upright position for well intervention; and at least one frame expansion mechanism having a retracted position and an expanded position, wherein the frame expansion mechanism is capable of vertically displacing a portion of the modular support frame when activated by moving from the retracted position to the expanded position.

2. The apparatus of claim 1, further comprising: a frame locking mechanism having a disengaged position and an engaged position, wherein the frame locking mechanism is capable of locking the frame expansion mechanism in the expanded position when the frame locking mechanism is activated by moving from said disengaged position to said engaged position.

3. The apparatus of claim 1, further comprising: a tower expansion mechanism, wherein the tower expansion mechanism is capable of vertically displacing a portion of said tower when activated.

4. The apparatus of claim 3, further comprising: a tower locking mechanism having a disengaged position and an engaged position, wherein the tower locking mechanism is capable of locking the tower expansion mechanism in the expanded position when the tower locking mechanism is activated by moving from said disengaged position to said engaged position.

5. The apparatus of claim 1, wherein said coiled tubing injector head interface plate is laterally movable over said first aperture.

* * * * *